US009302149B1

(12) United States Patent
Parker

(10) Patent No.: US 9,302,149 B1
(45) Date of Patent: Apr. 5, 2016

(54) ABDOMINAL EXERCISE APPARATUS

(71) Applicant: Darnyl Parker, Buffalo, NY (US)

(72) Inventor: Darnyl Parker, Buffalo, NY (US)

( * ) Notice: Subject to any disclaimer, the term of this patent is extended or adjusted under 35 U.S.C. 154(b) by 105 days.

(21) Appl. No.: 14/136,256

(22) Filed: Dec. 20, 2013

(51) Int. Cl.
*A63B 26/00* (2006.01)
*A63B 23/02* (2006.01)

(52) U.S. Cl.
CPC ..... *A63B 23/0211* (2013.01)

(58) Field of Classification Search
CPC ..... A63B 23/0211; A63B 23/0205; A63B 23/02; A63B 23/0238; A63B 23/0227; A63B 21/28; A63B 21/285; A63B 21/00054; A63B 21/000185; A63B 21/068; A63B 21/1457; A63B 21/1465; A63B 2208/0242; A63B 2208/0247; A63B 2208/0257; A63B 2208/0261; A63B 2225/10; A63B 2225/102; A63B 2225/105; A63B 2225/107
USPC ..... 482/87, 94
See application file for complete search history.

(56) References Cited

U.S. PATENT DOCUMENTS

| | | | | |
|---|---|---|---|---|
| 3,682,475 | A | 8/1972 | Walker | |
| 3,857,561 | A | 12/1974 | Cecchettini | |
| 4,332,381 | A | 6/1982 | Lyons | |
| 4,337,942 | A | 7/1982 | Sidlinger et al. | |
| 4,508,335 | A * | 4/1985 | Kelley et al. | 482/140 |
| 4,627,617 | A * | 12/1986 | Gilmore et al. | 482/92 |
| 4,729,561 | A | 3/1988 | Desjardins | |
| 5,306,220 | A | 4/1994 | Kearney | |
| 5,316,528 | A | 5/1994 | Ziparo | |
| 6,220,992 | B1 * | 4/2001 | Shafik | 482/83 |
| 6,309,329 | B2 | 10/2001 | Conner | |
| 6,458,062 | B2 | 10/2002 | Conner | |
| 6,689,026 | B2 | 2/2004 | Almada | |
| 7,662,077 | B1 * | 2/2010 | Liu | 482/142 |
| 2004/0266591 | A1 * | 12/2004 | Alessandri et al. | 482/94 |
| 2005/0079964 | A1 * | 4/2005 | Francavilla | 482/142 |
| 2005/0164851 | A1 * | 7/2005 | Eisa | 482/94 |
| 2005/0266971 | A1 | 12/2005 | Nguyen | |
| 2006/0116262 | A1 | 6/2006 | Pandozy | |
| 2007/0155602 | A1 | 7/2007 | Huls | |
| 2008/0058173 | A1 | 3/2008 | Mattox | |
| 2012/0295780 | A1 * | 11/2012 | Chou | 482/142 |
| 2015/0065321 | A1 * | 3/2015 | Goodson | 482/142 |

FOREIGN PATENT DOCUMENTS

| | | |
|---|---|---|
| FR | 2600542 | 12/1987 |

OTHER PUBLICATIONS

Josh Ellis (Drawn by), A300-Ab Crunch, Ab Crunch Engineering Drawing, May 27, 2010, Magnum Fitness Systems (Published by), Milwaukee, WI.

* cited by examiner

*Primary Examiner* — Oren Ginsberg
*Assistant Examiner* — Nyca T Nguyen
(74) *Attorney, Agent, or Firm* — Simpson & Simpson, PLLC

(57) ABSTRACT

An abdominal exercise apparatus designed to be utilized by one or two people. The abdominal exercise apparatus includes a base having a central arm, a post joined to the central arm and extending vertically therefrom, at least one pair of foot supports extending from the post, a pair of base sleeves, each of the pair of base sleeves joined to opposing sides of the base, a pair of supports, each of the supports having a first support end and a second support end, wherein the second support end is received by one of the base sleeves, and a pair of T-shaped knee rests, each of the T-shaped knee rests includes a long arm having a first end and a second end and a short arm attached to the first end of the long arm, wherein each of the second long arm ends is received by the first end of each of the pair of supports.

13 Claims, 3 Drawing Sheets

ABDOMINAL EXERCISE APPARATUS

FIELD OF THE INVENTION

The field of the present invention is exercise equipment or apparatus, more specifically, body weight equipment, and still specifically abdominal exercise equipment.

BACKGROUND OF THE INVENTION

Good health and physical fitness are of prime concern to a vast number of people. One problem with consistently maintaining an exercise regime is finding the discretionary time necessary to engage in a proper exercise program. Two problems in this regard are found in gyms in which persons must wait to use a particular piece of equipment and then pause in the midst of an exercise routine to adjust the equipment for the next repetition or exercise. The cumulative adjustment time over the course of an exercise routine can significantly reduce the amount of time spent actually exercising. These problems extend to machines and equipment that focus on exercising and developing the abdominal area.

U.S. Patent Application Publication No. 2007/0155602 to Huls discloses a sit-up exercise machine that comprises two slant boards with a pulley that enables two users to assist each other in performing sit-up exercises. However, the machine is constructed such that the two users cannot exercise independently. In addition, the machine must be elaborately modified to allow a single user to utilize the machine.

U.S. Pat. No. 6,689,026 to Almada provides for an abdominal exercise machine in which the user sits on a ball and places his/her feet in one of a plurality of foot supports. However, only one person at a time may use the Almada machine and the ball decreases stability of the user as he exercises.

U.S. Pat. No. 3,682,475 to Walker discloses an abdominal/back exercise machine in which the user sits on a raised small pivoting seat while his feet are held in place by a bar close to the floor. This arrangement allows the user to bend backwards but the narrow base and pivoting seat provide little stability and makes it awkward to effectively exercise the abdomen. Again, only one person may use the machine at a time.

U.S. Pat. No. 4,337,942 to Sidlinger provides for a slant board and single foot support to be used for sit-ups. The slant board is one of a variety of accessory pieces releasably attached to a common support. The Sidlinger device does not allow for the adjustment of the board to enable performing sit-ups at different angles and it can only be used by one person at a time.

U.S. Pat. No. 5,306,220 to Kearney discloses a weight lifting frame with various exercise stations. One of the stations is a Roman chair that enables back extension exercises but not abdominal crunch-type exercises. U.S. Pat. No. 5,316,528 to Ziparo discloses a bench with an adjustable stand and an aerobic step that enables a single user to perform various aerobic exercises. Both inventions can only be used by one person.

U.S. Patent Application Publication No. 2006/0116262 to Pandozy depicts a bench type apparatus with several pairs of foot supports on a flexible standard. The bench includes a half arc shaped hump that enables a more extensive movement in a sit-up exercise. The device is configured to only allow its use by a single person at a time.

Thus it is clear there is a need in the field for an abdominal exercise device or apparatus that enables easy adjustment to accommodate people of different sizes, more than one person at a time, and permit the targeting of different abdominal muscle groups.

SUMMARY OF THE INVENTION

The present invention broadly comprises an abdominal exercise apparatus including a base having a central arm, a post joined to the central arm and extending vertically therefrom, at least one pair of foot supports extending from the post, a pair of base sleeves, each of the pair of base sleeves joined to opposing sides of the base, a pair of supports, each of the supports having a first support end and a second support end, wherein the second support end is received by one of the base sleeves, and a pair of T-shaped knee rests, each of the T-shaped knee rests having a long arm including a first end and a second end and a short arm attached to the first end of the long arm, wherein each of the second long arm ends is received by the first end of each of the pair of supports. In an embodiment, the at least one pair of foot supports is a plurality of pairs of foot supports and each of the plurality of pairs of foot supports is arranged at a unique distance from the base.

In an embodiment, the base is H-shaped including two lateral arms joined by the central arm. In an embodiment, the central arm is joined at a midpoint of each of the two lateral arms.

In an embodiment, each of the pair of base sleeves further includes a plurality of adjustment holes and each of the second support ends includes a securing hole adapted to be aligned with one of the plurality of adjustment holes. In an embodiment, each of the pair of supports includes an upright support leg and a horizontal support leg wherein each of the upright support legs and each of the horizontal support legs are joined to form the pair of supports. In an embodiment, each of the first upright support legs is joined substantially perpendicular to each of the horizontal support legs. In an embodiment, each of the base sleeves includes a plurality of adjustment holes and each of the horizontal support legs includes a securing hole adapted to be aligned with one of the plurality of adjustment holes. In an embodiment, each of the horizontal support legs includes a plurality of adjustment holes and each of the base sleeves includes a securing hole adapted to be aligned with one of the plurality of adjustment holes. In an embodiment, each of the long arms includes a plurality of adjustment holes and each of the upright support legs includes a securing hole adapted to be aligned with one of the plurality of adjustment holes. In an embodiment, each of the upright support legs includes a plurality of adjustment holes and each of the long arms includes a securing hole adapted to be aligned with one of the plurality of adjustment holes.

In an embodiment, the at least one pair of foot supports includes a pad. In an embodiment, at least one of the short arms of the pair of the T-shaped knee rests includes a pad.

The present invention also broadly comprises an abdominal exercise apparatus including a base comprising a central arm, a post joined to the central arm and extending vertically therefrom, a plurality of foot supports each extending from the post and arranged at a unique distance from the base, a pair of base sleeves, each of the pair of base sleeves joined to opposing sides of the base, a pair of supports, each of the supports includes a first support end and a second support end, and a pair of T-shaped knee rests, each of the T-shaped knee rests includes a long arm having a first end and a second end and a short arm attached to the first end of the long arm. The second support end is received by one of the base sleeves, each of the pair of supports includes an upright support leg and a horizontal support leg and each of the upright support legs and each of the horizontal support legs are joined to form the pair of supports. Moreover, each of the second long arm ends is received by the first end of each of the pair of supports, each of the base sleeves includes a plurality of first adjustment holes and each of the horizontal support legs includes a first securing hole adapted to be aligned with one of the plurality of first adjustment holes. Each of the long arms includes a plurality of second adjustment holes and each of the upright support legs includes a second securing hole adapted to be aligned with one of the plurality of second adjustment holes.

An object of the invention is to provide an exercise apparatus that allows two users to exercise simultaneously.

An object of the invention is to provide an exercise device that is stable when a user is performing abdominal exercises.

An object of the invention is to provide an abdominal exercise device that permits selectable targeting of abdominal muscle groups.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
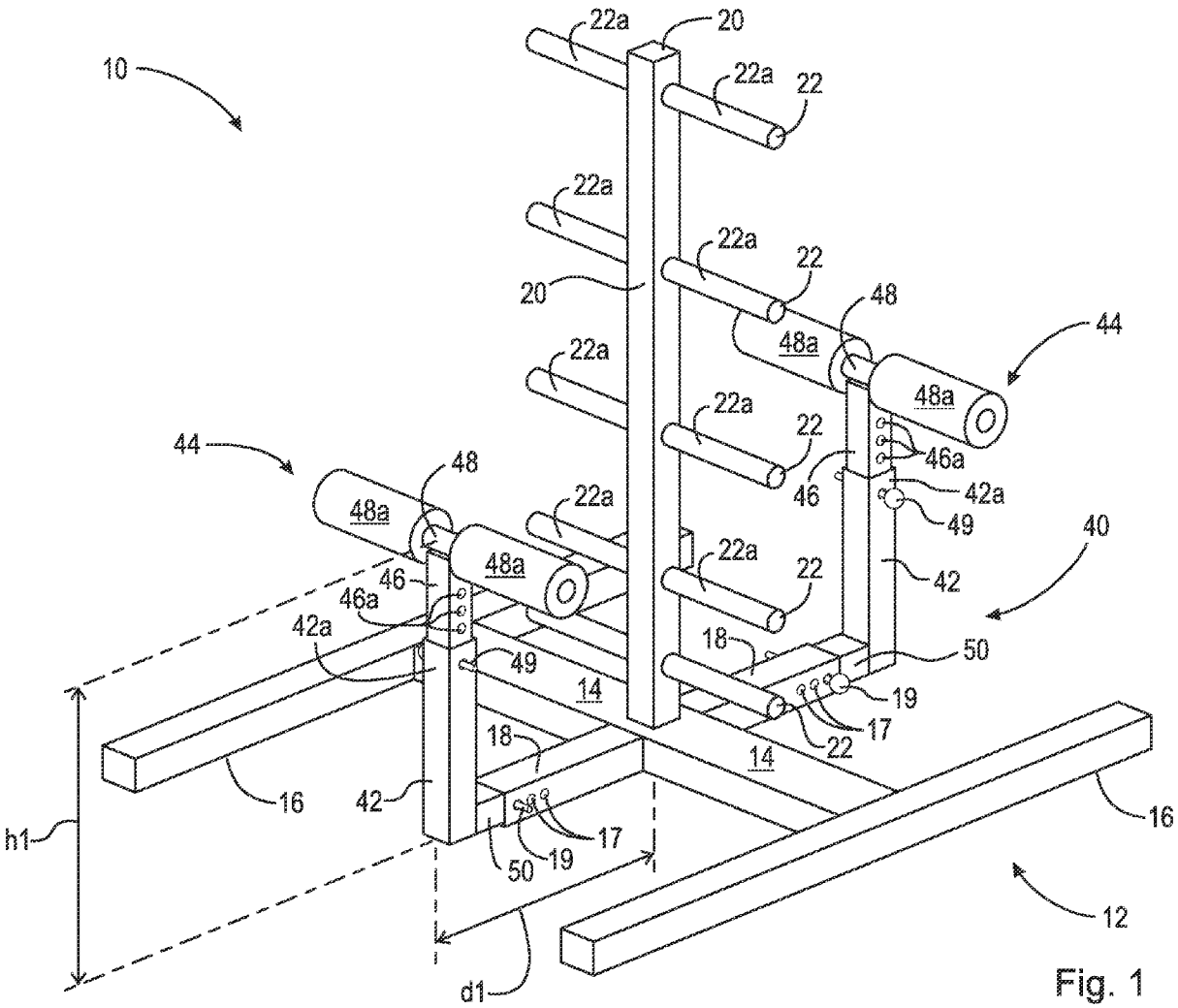
FIG. 1 is a top perspective view of the abdominal exercise apparatus of the present invention.

FIG. 1 is a top perspective view of abdominal exercise apparatus 10 ("apparatus 10"). Base 12 includes central arm 14 connected to support post 20. Post 20 extends vertically from central arm 14. In the embodiment shown, base 12 includes two lateral arms 16 joined at their midpoints by central arm 14. Post 20 may be joined to central arm 14 by welding, nut and bolt assemblies, or other equivalents thereto. Post 20 supports at least one and preferably a plurality of pairs of foot/ankle supports 22. In an embodiment, foot/ankle supports 22 are covered by pads 22*a*. "Foot/ankle support" is intended to mean the plurality of arms that extend substantially perpendicularly from center post 20 and support the feet and/or ankles of the user.

A pair of base sleeves 18 is attached to opposing sides of central arm 14. Preferably, base sleeves 18 are attached directly opposite each other as shown in FIG. 1; however, their respective attachment may be offset. Base sleeves 18 may be attached by welding, brazing, nut and bolt assemblies or other methods well known to those skilled in the art. Knee rest assemblies 40 ("assemblies 40") are adjustably received by one end of base sleeves 18 opposite the point of attachment to arm 14. Assemblies 40 include supports 42 with first support end 42*a*. Knee rests 44 are T-shaped with the long arm 46 supporting short arm 48 at one end with the opposing end received into first support end 42*a*. Short arm 48 is mounted substantially perpendicularly across long arm 46 as shown. "Substantially" is intended to mean in this context, that long arm 46 and short arm 48 are perceived by an ordinary observer without measurement as attached at right angles. Short arm 48 may be mounted by welding, brazing, brackets, or other methods known to those skilled in the art. Pads 48*a* cover short arm 48 on either side of the union with long arm 46. Pins 49 hold long arms 46 in place within supports 42, i.e., at height h1. Pins 19 hold supports 42 in place within base sleeves 18, i.e., at distance d1. Apparatus 10 is preferably fabricated from metal, wood, plastic, or combinations thereof.

Figure 2:
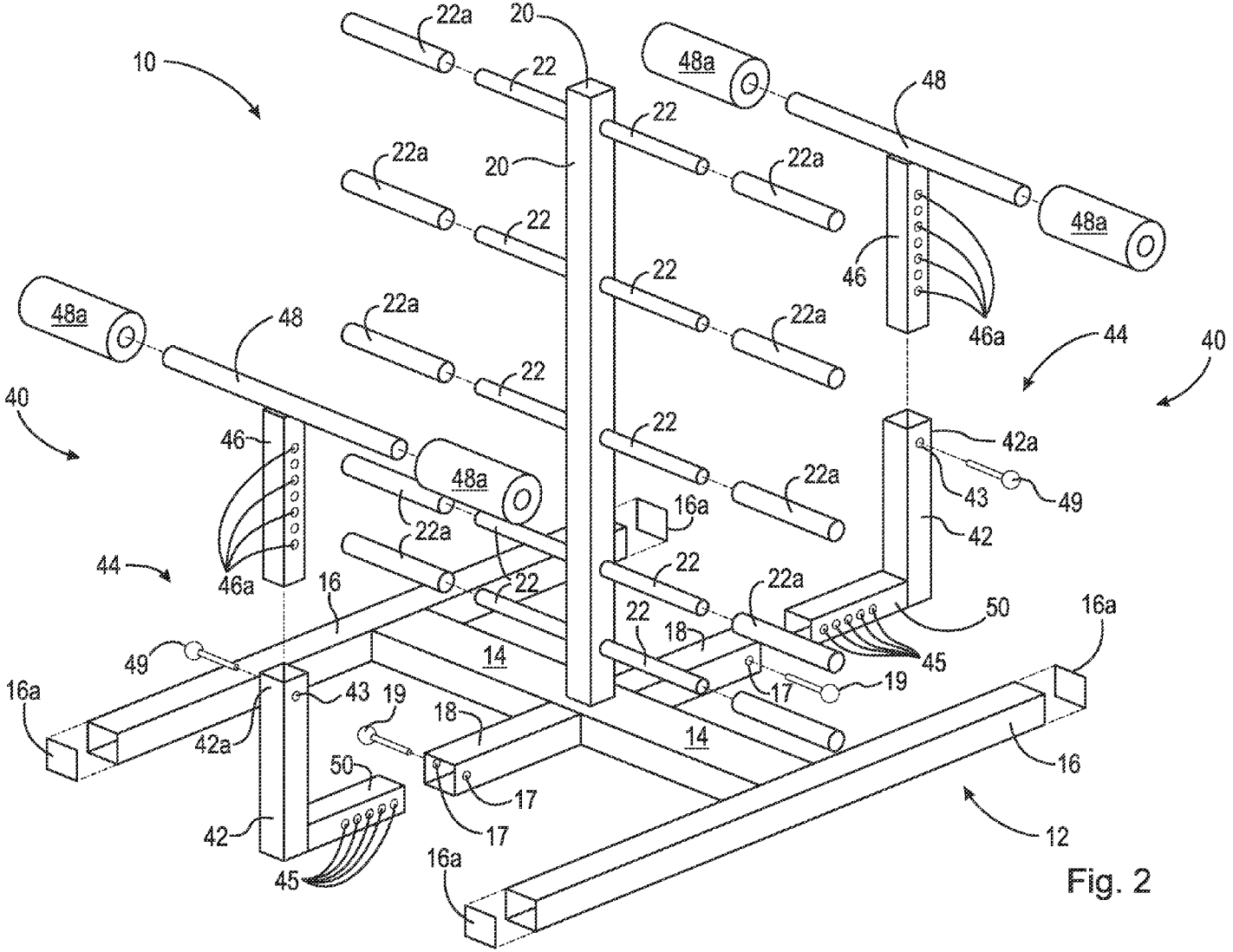
FIG. 2 is an exploded version of the view seen in FIG. 1.

FIG. 2 is an exploded view of the present apparatus depicted in FIG. 1. FIG. 2 more clearly depicts an embodiment of support 42 arranged to secure knee rest 44 at a suitable height above the floor, i.e., height h1. In the figure, support 42 includes upright support leg 42*a* and horizontal support leg 50 joined together substantially at right angles. This configuration provides the advantage of allowing support 42 to be supported by the floor. Also seen is a plurality of paired adjustment holes 46*a* along the length of support 46. A pair of adjustment holes is aligned with support pin hole 43 at or near first support leg 42*a*. This arrangement allows knee rest assembly 40 to be raised vertically up or down adjusting the distance of short arm 48 above the floor, i.e., height h1. Similarly, paired adjustment holes 45 in support 42 allow the adjustment of the horizontal distance of assembly 40 from post 20 when aligned with sleeve pin hole 17, i.e., distance d1. It will be recognized that a plurality of pin holes 17 and 43 may be placed along base sleeves 18 and upright support 42, respectively, as opposed to plurality of pin holes 45 and 46*a*. For example, as shown in FIG. 1, sleeves 18 may comprise a plurality of sleeve pin holes 17, while as shown in FIG. 2, horizontal support leg 50 may comprises a plurality of pin holes 45. Also seen are end caps 16*a* at the each end of lateral arms 16.

Figure 3:
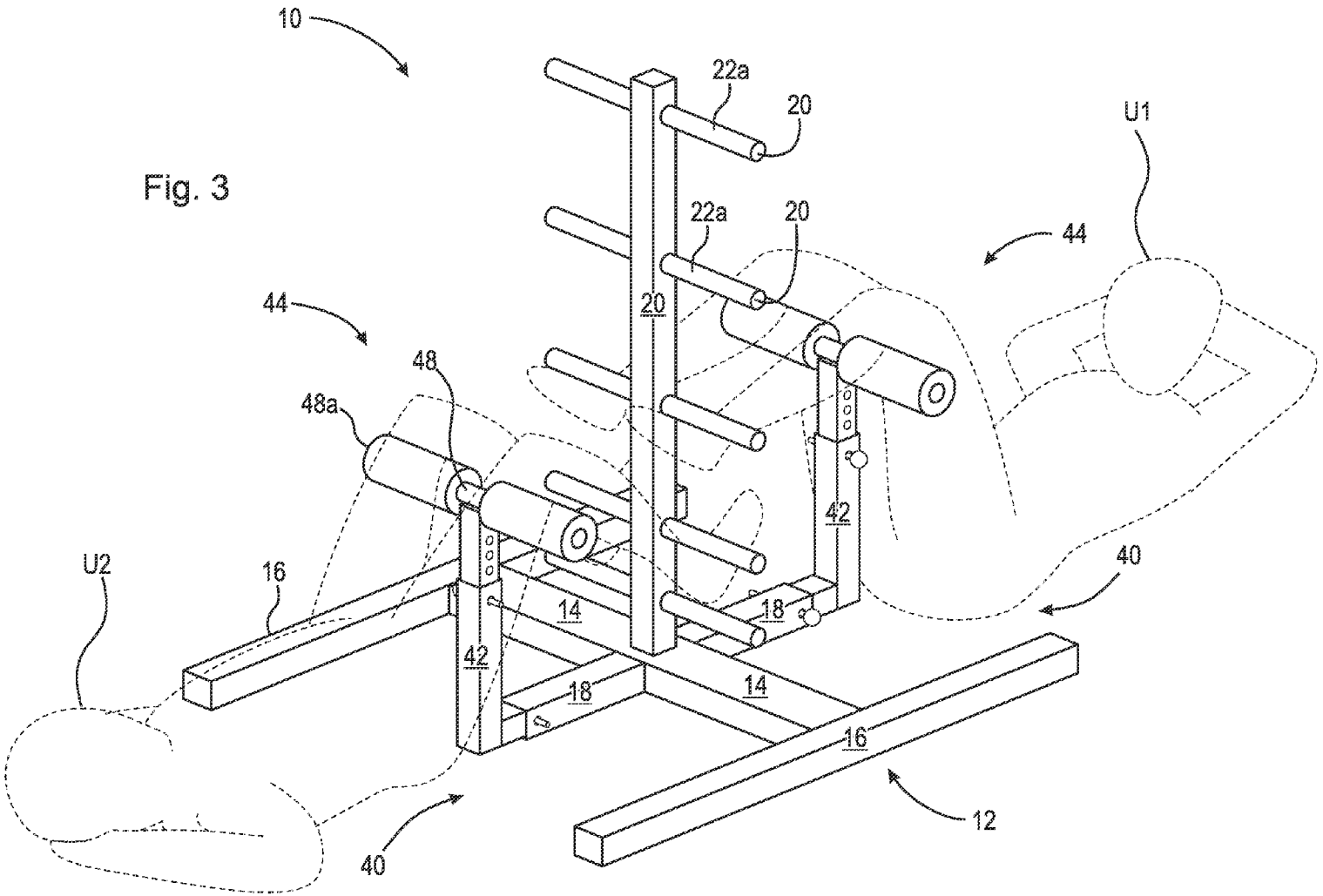
FIG. 3 is a top perspective view of the abdominal exercise apparatus in use simultaneously by two users.

FIG. 3 is a top perspective view of abdominal exercise apparatus 10 in use simultaneously by two users U1 and U2

(collectively "users U"). It can be seen that each user U is using a different pair of foot/ankle supports 22. Because base sleeves 18 are directly opposite from each other, the two users U counterbalance apparatus 10; however, such counterbalancing is not needed to use apparatus 10. The plurality of foot/ankle supports 22 allows for users U with different leg lengths to use apparatus 10 at the same time. Floor supported crunches may also be performed simultaneously by two users U or by a single user U. Furthermore, provided supports 22 comprise sufficient length users U may simultaneously utilize the same support 22.

The present apparatus is an abdominal exercise device having various adjustments available for leg and feet positioning. The apparatus comprises a fixed base having a fixed centrally located post. Feet engagement rods are positioned at various heights along the central post, while two knee supports are positioned on opposite sides of the central post. Each knee support provides two degrees of freedom: 1) towards and away from the central post; and, 2) up and down parallel to the central post. The various heights of the feet engagement rods and the two degrees of freedom of the knee supports permit people having different leg lengths to utilize the same apparatus, as well as altering the set of muscle groups which is targeted while using the apparatus. Moreover, the apparatus permits two different configurations to be maintained on the same device thereby allowing two people to simultaneously use the apparatus and minimizing changeover time during use.

Thus it is seen that the objects of the invention are efficiently obtained, although changes and modifications to the invention should be readily apparent to those having ordinary skill in the art, which changes would not depart from the spirit and scope of the invention as claimed.

What I claim is:

1. An abdominal exercise apparatus comprising:

a base comprising a central arm;

a post joined to the central arm and extending vertically therefrom;

at least one pair of foot supports extending from the post;

a pair of base sleeves, each base sleeve of the pair of base sleeves joined to opposing sides of the central arm;

a pair of supports, each of the supports comprising a first support end and a second support end, wherein the second support end is received by one of the base sleeves; and, a pair of T-shaped knee rests, each of the T-shaped knee rests comprise a long arm having a first end and a second end and a short arm attached to the first end of the long arm, wherein each second end of each long arm is received by the first support end of each support of the pair of supports, wherein the base is H-shaped comprising two lateral arms joined by the central arm.

2. The abdominal exercise apparatus as recited in claim 1 wherein each support of the pair of supports comprises an upright support leg and a horizontal support leg wherein each of the upright support legs and each of the horizontal support legs are joined to form the pair of supports.

3. The abdominal exercise apparatus as recited in claim 2 wherein each of the first upright support legs is joined substantially perpendicular to each of the horizontal support legs.

4. The abdominal exercise apparatus as recited in claim 2 wherein each of the base sleeves comprises a plurality of adjustment holes and each of the horizontal support legs comprises a securing hole adapted to be aligned with one of the plurality of adjustment holes.

5. The abdominal exercise apparatus as recited in claim 2 wherein each of the horizontal support legs comprises a plurality of adjustment holes and each of the base sleeves comprises a securing hole adapted to be aligned with one of the plurality of adjustment holes.

6. The abdominal exercise apparatus as recited in claim 2 wherein each of the long arms comprises a plurality of adjustment holes and each of the upright support legs comprises a securing hole adapted to be aligned with one of the plurality of adjustment holes.

7. The abdominal exercise apparatus as recited in claim 2 wherein each of the upright support legs comprises a plurality of adjustment holes and each of the long arms comprises a securing hole adapted to be aligned with one of the plurality of adjustment holes.

8. The abdominal exercise apparatus as recited in claim 1 wherein the at least one pair of foot supports is a plurality of pairs of foot supports and each pair of foot supports of the plurality of pairs of foot supports arranged at a distance from the base different than each distance from the base of the other pairs of foot supports of the plurality of pairs of foot supports.

9. The abdominal exercise apparatus as recited in claim 1 wherein the central arm is joined at a midpoint of each lateral arm of the two lateral arms.

10. The abdominal exercise apparatus as recited in claim 1 wherein each base sleeve of the pair of base sleeves further comprises a plurality of adjustment holes and each of the second support ends comprises a securing hole adapted to be aligned with one of the plurality of adjustment holes.

11. The abdominal exercise apparatus as recited in claim 1 wherein the at least one pair of foot supports comprises a pad.

12. The abdominal exercise apparatus as recited in claim 1 wherein at least one of the short arms of the pair of the T-shaped knee rests comprises a pad.

13. An abdominal exercise apparatus comprising:

a base comprising a central arm;

a post joined to the central arm and extending vertically therefrom;

a plurality of pairs of foot supports each extending from the post and arranged at a distance from the base different than each distance from the base of the other pairs of foot supports of the plurality of pairs of foot supports;

a pair of base sleeves, each base sleeve of the pair of base sleeves joined to opposing sides of the central arm;

a pair of supports, each of the supports comprising a first support end and a second support end, wherein the second support end is received by one of the base sleeves, each support of the pair of supports comprises an upright support leg and a horizontal support leg and each of the upright support legs and each of the horizontal support legs are joined to form the pair of supports; and, a pair of T-shaped knee rests, each of the T-shaped knee rests comprise a long arm having a first end and a second end and a short arm attached to the first end of the long arm, wherein each second end of each long arm is received by the first support end of each support of the pair of supports, each of the base sleeves comprises a plurality of first adjustment holes, each of the horizontal support legs comprises a first securing hole adapted to be aligned with one of the plurality of first adjustment holes, each of the long arms comprises a plurality of second adjustment holes, each of the upright support legs comprises a second securing hole adapted to be aligned with one of the plurality of second adjustment holes and the base is H-shaped comprising two lateral arms joined by the central arm.

* * * * *